US009546819B2

(12) United States Patent
Thillen et al.

(10) Patent No.: US 9,546,819 B2
(45) Date of Patent: Jan. 17, 2017

(54) ROTARY CHARGING DEVICE FOR SHAFT FURNACE

(71) Applicant: PAUL WURTH S.A., Luxembourg (LU)

(72) Inventors: Guy Thillen, Diekirch (LU); Christian Benoit Thix, Luxembourg (LU); Lionel Hausemer, Sandweiler (LU)

(73) Assignee: PAUL WURTH S.A., Luxembourg (LU)

( * ) Notice: Subject to any disclaimer, the term of this patent is extended or adjusted under 35 U.S.C. 154(b) by 52 days.

(21) Appl. No.: 14/415,888

(22) PCT Filed: Jul. 15, 2013

(86) PCT No.: PCT/EP2013/064912
§ 371 (c)(1),
(2) Date: Jan. 20, 2015

(87) PCT Pub. No.: WO2014/012890
PCT Pub. Date: Jan. 23, 2014

(65) Prior Publication Data

US 2015/0204608 A1 Jul. 23, 2015

(30) Foreign Application Priority Data

Jul. 18, 2012 (LU) ..... 92046

(51) Int. Cl.
*F27B 1/20* (2006.01)
*C21B 7/20* (2006.01)
(Continued)

(52) U.S. Cl.
CPC . *F27B 1/20* (2013.01); *C21B 7/20* (2013.01); *F27D 3/00* (2013.01); *F27D 3/0025* (2013.01); *F27D 3/0033* (2013.01); *F27D 3/10* (2013.01)

(58) Field of Classification Search
CPC ..... F27B 1/20; F27D 3/00; F27D 3/0025; F27D 3/0033; F27D 3/10
See application file for complete search history.

(56) References Cited

U.S. PATENT DOCUMENTS 3,693,812 A 9/1972 Mahr et al.
3,814,403 A * 6/1974 Legille ..... C21B 7/20 414/206
(Continued)

FOREIGN PATENT DOCUMENTS

EP 0863215 A1 9/1998
EP 2487440 A1 8/2012
(Continued)

OTHER PUBLICATIONS

International Search Report and Written Opinion issued Feb. 17, 2014 re: Application No. PCT/EP2013/064913; citing: US 2012/045298 A1, JP 63 096205 A, WO 2010/139776 A1 , WO 2010/139761 A1, WO 2012/016902 A1 and FR 2 692 595 A1.
(Continued)

*Primary Examiner* — Kaitlin Joerger
(74) *Attorney, Agent, or Firm* — Cantor Colburn LLP

(57) ABSTRACT

A rotary charging device for a shaft furnace comprises a stationary housing (16) for mounting on the throat (12) of the shaft furnace and a suspension rotor (22) supported therein so that it can rotate about a substantially vertical axis (A), said suspension rotor (22) and stationary housing (16) cooperating to delimit an annular chamber forming the main casing (36) of said rotary charging device. A charge distributor (28) is pivotally suspended to the suspension rotor (22). The device further comprises: rotary drive means for rotating the suspension rotor (22) about its axis; independent tilting drive means for pivoting the charge distributor (28) about a substantially horizontal pivoting axis (B) that include: a tilting motor ($M_B$) with horizontal output shaft
(Continued)

(52) fixedly mounted relative to the stationary housing (16); a tilting drive shaft (58) in the main housing (36) that is mounted onto the suspension rotor (22), an outward end (60) of the tilting drive shaft (58) being coupled to the tilting motor ($M_B$) by motion transfer means (64) while the opposite inward end (62) of the tilting drive shaft is coupled to the charge distributor (28) to selectively operate its pivoting, the motion transfer means (64) being configured in such a way as to allow transmitting power from the tilting motor ($M_B$) to the tilting drive shaft (58) at any angular position of the suspension rotor (22).

18 Claims, 4 Drawing Sheets

(51) Int. Cl.
*F27D 3/00* (2006.01)
*F27D 3/10* (2006.01)

(56) References Cited

U.S. PATENT DOCUMENTS

| | | | | |
|---|---|---|---|---|
| 6,580,744 | B1 * | 6/2003 | Irnich | F27B 1/20 373/79 |
| 7,861,614 | B2 * | 1/2011 | Sim | B65G 69/0441 414/206 |
| 8,419,336 | B2 * | 4/2013 | Fletcher | C21B 7/20 414/207 |
| 8,701,856 | B2 * | 4/2014 | Tomisaki | C21B 7/20 193/16 |
| 8,920,710 | B2 * | 12/2014 | Thillen | C21B 7/20 266/197 |
| 9,133,529 | B2 * | 9/2015 | Thillen | C21B 7/20 |
| 9,146,057 | B2 * | 9/2015 | Thillen | C21B 7/20 |
| 2012/0045298 | A1 * | 2/2012 | Thillen | C21B 7/20 414/206 |
| 2012/0070253 | A1 * | 3/2012 | Thillen | C21B 7/20 414/199 |
| 2015/0204608 | A1 * | 7/2015 | Thillen | C21B 7/20 414/206 |
| 2015/0211793 | A1 * | 7/2015 | Thillen | C21B 7/20 414/152 |

FOREIGN PATENT DOCUMENTS

| | | | |
|---|---|---|---|
| FR | 2692595 | A1 | 12/1993 |
| JP | 57116719 | A | 7/1982 |
| JP | 58207303 | A | 12/1983 |
| JP | 63096205 | A | 4/1988 |
| WO | 0224962 | A1 | 3/2002 |
| WO | 2007082633 | A1 | 7/2007 |
| WO | 2010139761 | A1 | 12/2010 |
| WO | 2010139776 | A1 | 12/2010 |
| WO | 2011023772 | A1 | 3/2011 |
| WO | 2012016902 | A1 | 2/2012 |

OTHER PUBLICATIONS

International Search Report issued Jan. 22, 2014 and International Preliminary Report on Patentability issued on Nov. 7, 2014 re: Application No. PCT/EP2013/064912; citing: EP 2 487 440 A1, WO 02/24962 A1, US 2012/045298 A1, WO 2010/139761 A1, WO 2010/139776 A1, JP 58 207303 and JP 57 116719 A.

* cited by examiner

ROTARY CHARGING DEVICE FOR SHAFT FURNACE

FIELD OF THE INVENTION

The present invention generally relates to a charging installation for a shaft furnace and in particular to a rotary charging device for distributing charge material in a shaft furnace. More specifically, the invention relates to the type of device that is equipped with a chute for circumferential and radial distribution of the charge material.

BACKGROUND OF THE INVENTION

Rotary charging devices using a chute for circumferential and radial distribution of the charge material have been known for several decades, mainly thanks to the present Applicant who brought the BELL LESS TOP® to industry in the early 1970s.

Such rotary charging device is e.g. described in U.S. Pat. No. 3,693,812. It comprises a suspension rotor and a chute adjustment rotor that are supported in a stationary housing so as to be rotatable about a substantially vertical rotation axis. The chute is suspended to the suspension rotor so that it rotates with the latter for circumferential distribution of charge material. Furthermore, the chute is suspended to be pivotally adjustable about a substantially horizontal axis for radial distribution of charge material. The suspension rotor and the adjustment rotor are driven by a differential drive unit that is equipped with a main rotation drive, namely an electric motor, and an adjustment drive, namely an electric motor. The latter allows creating differential rotation between the suspension rotor and the adjustment rotor. A pivoting mechanism is provided for angular adjustment of the chute. This mechanism, which is connected to the chute and actuated by the rotor, transforms a variation in angular displacement between the suspension rotor and the adjustment rotor due to differential rotation, into a variation of the pivotal position i.e. the tilt angle of the chute.

The rotary charging device of U.S. Pat. No. 3,693,812 is further equipped with a drive unit for driving the two rotors. This unit is enclosed in a casing arranged on the stationary housing that supports the rotors and the chute. The casing has a primary input shaft; a secondary input shaft; a first output shaft, hereinafter called rotation shaft; and a second output shaft, hereinafter called adjustment shaft. The primary input shaft is driven by the main rotation drive. Inside the casing, a reduction mechanism connects the primary input shaft to the rotation shaft, which extends vertically inside the stationary housing where it is provided with a gearwheel that meshes with a gear ring of the suspension rotor. The adjustment shaft also extends vertically into the stationary housing where it is provided with a gearwheel that meshes with a gear ring of the adjustment rotor. Inside the casing of the drive unit, the rotation shaft and the adjustment shaft are interconnected by means of an epicyclic differential mechanism, i.e. a sun-and-planet gear train. The latter mainly comprises a horizontal annulus (ring gear) that has external teeth meshing with a gearwheel on the rotation shaft; a sun gear that is connected to the secondary input shaft; at least two planet gears that mesh with internal teeth of the annulus and with the sun gear. This sun-and-planet gear train is dimensioned so that the rotation shaft and the adjustment shaft have the same rotational speed imparted by the main rotation drive when the secondary input shaft is stationary, i.e. when the adjustment drive is at stop. The adjustment drive is a reversible drive and connected to the secondary input shaft. By virtue of the differential mechanism, the adjustment drive allows driving the adjustment shaft at a faster and at a lower rotational speed than the rotation shaft to thereby produce a relative i.e. differential rotation between the suspension rotor and the adjustment rotor. The pivoting mechanism transforms such differential rotation into pivoting motion of the chute.

Such rotary charging device with distribution chute has proven very successful in industry and various manufacturers have developed their own versions. In the majority of designs, the drive motors, drive unit, the rotation shaft and adjustment shaft are arranged vertically, generally on the top of the stationary housing. As described above, the rotation drive may be achieved relatively easily by a pinion engaging a ring gear attached to the supporting rotor. The tilting drive is more complex as the torque provided by the vertical electric motor has to be converted in such a way to be able to pivot the distribution chute about the horizontal axis. In this regard, the design of the tilting mechanism has led to many developments, using connecting rods, cables, or hydraulic cylinders and specially designed gears. In particular, the tilting drive unit described above is a key component of the device for distributing charge material. Since it is custom made, it represents a significant part of the total cost of the device. Moreover, in order to ensure continuous operation of the furnace when the drive unit requires servicing or major repair, a complete spare unit is typically kept in stock by the furnace operator.

Over the years, the motivations that lead to the development of new designs where:

- improving the compactness of the device, in particular for small/medium blast furnace installations;
- improving the reliability of the rotary and tilting drive mechanisms;
- facilitating the access to the stationary housing, which may be difficult complicated by the various external casings mounted thereto;
- reducing the quantity of casing openings (seals, gaskets . . . )
- improving the reliability of the rotary and tilting drive mechanisms.

In EP 0 863 215 it has been proposed to actuate the chute by means of an electrical motor arranged on the rotating part (suspension rotor) that supports the chute. This solution eliminates the need for a highly developed mechanical gear arrangement for varying the chute inclination. It does however require means for electric energy transfer, from the stationary part to the rotatable part, in order to power the electric motor on the chute-supporting rotor.

The solution provided in EP 0 863 215 seems however unfinished and inappropriate for practical use to face the harsh industrial condition, with substantial dust and heat. The power supply to the tilting drive is another problem, not addressed therein.

BRIEF SUMMARY OF THE INVENTION

The invention provides an alternative design of rotary charging device allowing an easy control of the distribution chute.

According to the present invention, a rotary charging device comprises:

a stationary housing for mounting on the throat of the shaft furnace;

a suspension rotor supported in said stationary housing so that it can rotate about a substantially vertical axis, the suspension rotor and stationary housing cooperating to delimit an annular chamber forming the main casing of said rotary charging device;

a charge distributor pivotally suspended to said suspension rotor;

rotary drive means for rotating the suspension rotor about its axis;

tilting drive means for pivoting the charge distributor about a substantially horizontal pivoting axis, independently from the rotary drive means, wherein the tilting drive means comprises:

a tilting motor, preferably an electric motor, fixedly mounted relative to the stationary housing and laterally positioned relative to the suspension rotor, the tilting motor output shaft being preferably horizontal;

a tilting drive shaft in the main housing that is mounted onto the suspension rotor (22), an outward, first end (60) of the tilting drive shaft being coupled to the tilting motor by motion transfer means while the opposite, inward second end of the tilting drive shaft is coupled to the charge distributor to selectively operate pivoting thereof, the motion transfer means being configured for operating peripherally to the suspension rotor in such a way as to allow transmitting power from the tilting motor to the tilting drive shaft at any angular position of the suspension rotor.

The invention hence provides a rotary distribution device for shaft furnaces where the rotational and tiling drives can be separately/independently controlled. It shall be appreciated that for pivoting the charge distributor, the suspension rotor carries a tilting drive shaft that may be simply coupled to a suspension arm of the charge distributor by a pair of gears. This thus allows actuation via a simple and robust mechanism on the suspension rotor in the vicinity of the charge distributor.

The present rotary distribution device has many benefits, in particular:

- the tilting and rotary drive means are decoupled/independent, which facilitates the mechanical design of the different mechanisms;
- the lateral installation of the tilting motor frees up some space in the region above the stationary housing;
- the tilting motor may be arranged inside the main casing and thus protected from the harsh outside environment.

Preferably, the suspension rotor comprises a cylindrical body and a substantially horizontal bottom flange; such configuration is however not limitative and other designs may be used.

In general, the rotary drive means may comprise a rotary motor, preferably electric motor, which may be mounted outside or inside the stationary housing (with its output shaft vertical or horizontal) and operatively coupled to the suspension rotor by a main transmission. The rotary motor may e.g. be mounted so that its output shaft is substantially horizontal and said main transmission comprises an input gear driven by said output shaft and meshing with a toothed ring coaxial with and rotationally integral with said suspension rotor.

The rotary motor is preferably mounted laterally to the stationary housing, respectively to the suspension rotor, and preferably inside the main casing, in such way that its output shaft is substantially horizontal. The lateral arrangement of the rotary motor again frees up some space above the rotary distribution device and reduces its height.

Preferably, the motion transfer means comprise a pair of rotationally integral large diameter toothed rings mounted in the main casing so as to be rotatable about the vertical axis, typically surrounding the suspension rotor. A first of the toothed rings is connected to the tilting motor to be driven thereby, while the second toothed ring is operatively coupled to the tilting shaft first end in such a way that the rotation of the toothed rings results in a corresponding rotation of the tilting drive shaft about its axis. This toothed rings assembly is preferably rotationally supported by a rolling bearing, in particular a slewing bearing.

The large diameter toothed rings may be arranged in a sub-chamber of the main casing, separate from the suspension rotor and the tilting drive shaft. In such case, the motion transfer means is preferably configured to operate the coupling of the second toothed ring to the tilting drive shaft through an annular slit connecting the sub-chamber containing the toothed rings from the sub-chamber having its inner end delimited by the suspension rotor.

In one embodiment, the motion transfer means comprises a worm gear set coupling said second toothed ring to the tilting drive shaft. Such a configuration with worm gear is advantageous to transfer higher torques to tilting drive means.

In another embodiment, an annular partition wall is rotatably mounted in the main casing and rotationally integral with the suspension rotor. The tilting drive shaft traverses the partition wall and has at its first end a gear wheel meshing with one of said toothed rings, while the other toothed ring is connected to the tilting motor to be driven thereby. Preferably, a further tilting drive shaft is mounted on the suspension rotor opposite the first drive shaft, similarly driven by the toothed rings however connected to the respective suspension arm of the charge distributor by a rotation inverter.

BRIEF DESCRIPTION OF THE DRAWINGS

The present invention will now be described, by way of example, with reference to the accompanying drawings, in which.

DETAILED DESCRIPTION OF PREFERRED EMBODIMENTS

Figure 1:
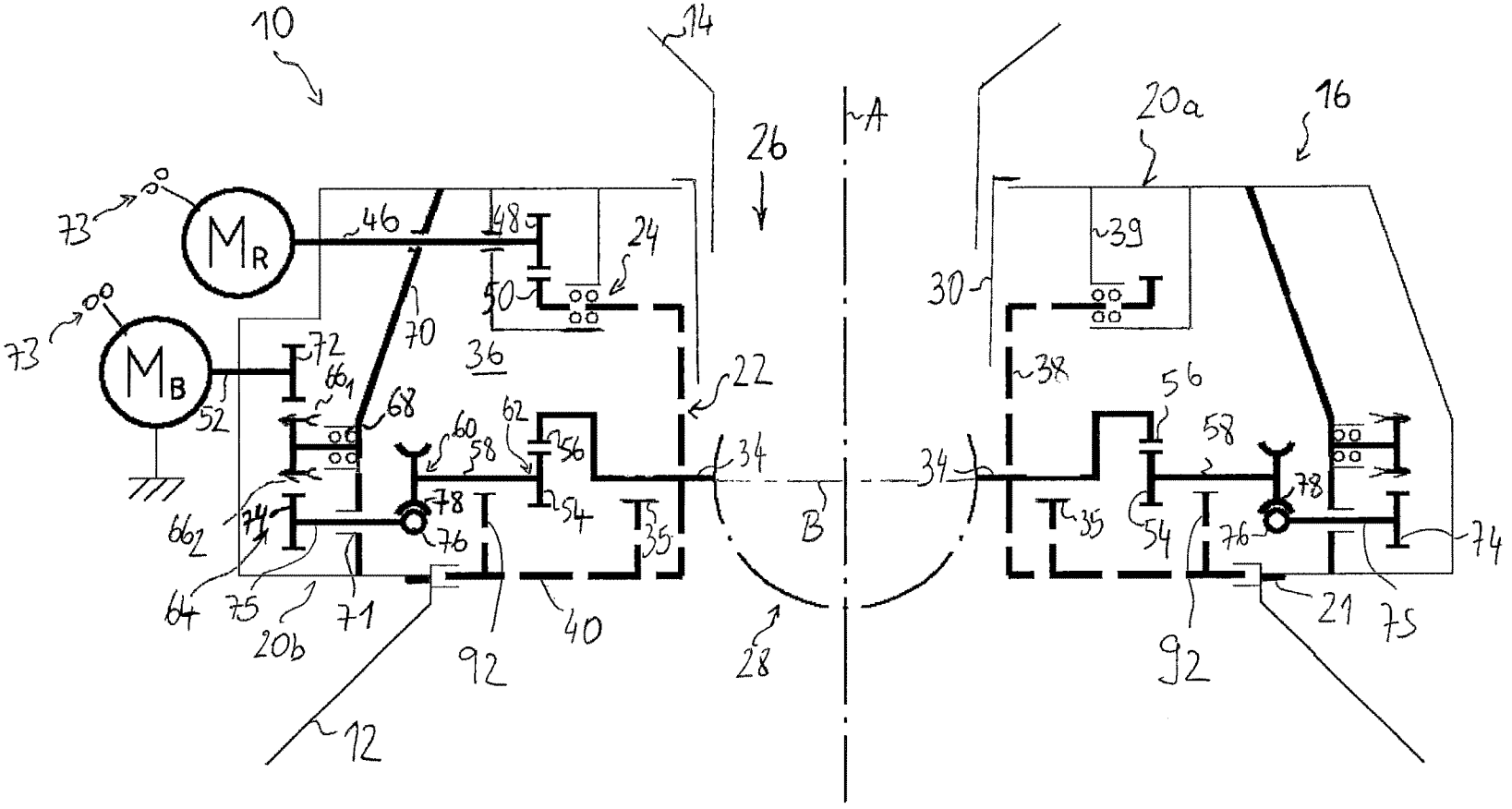
FIG. 1: is a schematic diagram, in cross-section, of a first embodiment of the present rotary charging device.

FIG. 1 shows the main elements of a first embodiment of rotary distribution device 10 for distributing bulk charge material ("burden") into a shaft furnace, especially onto the stock-line of a blast furnace. As it is known in the art, the device 10 is part of a top charging installation and is arranged to close the top opening of the reactor, e.g. on the throat 12 of the blast furnace. The distribution device 10 is fed with charge material from one or more intermediate storage hoppers (not shown), e.g. according to a configuration as disclosed in WO 2007/082633. In FIG. 1, a funnel 14 guides the charge material discharged from the hoppers into the rotary distribution device 10.

The distribution device 10 has a fixed structure forming a stationary housing 16 sealing mounted to the furnace throat 12, which includes a fixed external casing 18 that extends between upper and lower flange structures 20*a*, 20*b*. In the variant of FIG. 1, the stationary housing 16 is fixed by its lower flange structure 20*b* to the top ring 21 of the furnace throat 12, which constitutes a machined flange.

Inside the housing 16, a suspension rotor, generally identified at 22, is rotationally mounted about a substantially vertical rotation axis A that corresponds e.g. to the blast furnace axis. This can be carried out by means of a large-diameter annular rolling bearing 24, generally a roller bearing and preferably a slewing bearing, supported by the stationary housing structure 16. This annular rolling bearing extends circumferentially about axis A.

The burden material discharged from above the device 10 and guided by funnel 14 flows through a central channel 26 in the device 10 and arrives at the distribution chute generally identified at 28. The inner dimensions of the central channel 26 generally depend on the cross-section of the suspension rotor 22. However, a feeding spout 30 is preferably arranged inside the suspension rotor 22 and fixedly mounted to the stationary housing 16. The axial extent of the feeding spout 30 may depend on the design. In the present variant the feeding spout 30 extends from the top opening 32 of the device 10 down to the chute 28. Since the feeding spout 30 is here placed inside rotor 22, the cross-section of channel 26 depends on the latter.

The distribution chute 28 is mounted to the suspension rotor 22 so as to rotate in unison therewith about axis A. The chute 28 actually comprises a pair of lateral suspension arms 34 (or trunnions) by means of which it is suspended, in a known manner, to mounting bearings 35 (e.g. roller bearings or plain bearings) in rotor 22 and that further allow its tilting/pivoting about a horizontal axis B. The chute 28 being generally installed in the lower region of the feed channel 26, the burden material—having entered the distribution device 10 at its top—falls, through rotor 22, into the chute 28 to be distributed in the furnace.

As it will be understood, the suspension rotor 22 and the stationary housing 16 cooperate to form the main casing 36 of the rotary charging device 10 and hence define a substantially closed annular chamber surrounding the central feed channel 26. In this connection, it may be noticed that in all of the figures the suspension rotor 22 is shown with dashed lines for the sake of illustration only; it does not imply that it should have some traversing openings in its body/bottom parts. In some cases, the main casing 36 may comprise one or more inner partition walls extending on whole or part of the circumference, as will be discussed below.

It may be noticed that suspension rotor 22 comprises a tubular support or body 38 that is arranged coaxial with the rotation axis A and that actually supports the chute 28. The tubular body 38 extends vertically in the central channel 26 and is operationally connected and supported by one race of the rolling bearing 24, the other race being fixedly attached, in this embodiment, to a fixed annular wall 39 of structure 16. Rotor 22 advantageously comprises a bottom 40 formed as an annular flange. The bottom 40 has a, amongst others, a protective function by forming a kind of screen between the interior of the main casing 22 and the interior of the furnace. The bottom 40 of the suspension rotor 22 extends laterally/radially in close proximity of the bottom flange 20*b* of the stationary housing 16.

Rotary drive means are provided for rotating the suspension rotor 22 about axis A. It may comprise an electric motor $M_R$, which is here fixed to the stationary housing 16, on the outside thereof, with its output shaft 46. The rotary motor $M_R$ is operatively coupled to the suspension rotor 22 by a main transmission. The main transmission may include an input gear 48 (vertical) fixed on the output shaft 46 that drives a toothed ring 50 surrounding and rotationally integral with the suspension rotor 22. Toothed ring 50 is preferably fixed to the bearing race supporting rotor 22.

It shall be appreciated that the device 10 further comprises tilting drive means, independent from the rotary drive means, to selectively operate the tilting of the distribution chute 28 by rotating the latter about its suspensions arms 34, hence about axis B.

The tiling drive means comprise a tilting motor $M_B$, preferably an electric motor, fixedly installed relative to the stationary housing 16. Motor $M_B$ is laterally arranged relative to the suspensions rotor 22 (i.e. below upper flange 20*a*), preferably with its output shaft 52 substantially horizontal. A tilting input gear 54 is driven by the tilting motor $M_B$, whereas a tilting output gear 56 is rotationally integral with one arm 34 of the chute distributor 28, the tilting input gear 54 meshing with the tilting output gear 56. In practice, the input gear 54 may be a wheel with external toothing while the output gear 56 may take the form of a concave toothed segment integral with the chute arm 34.

It shall be appreciated that a tilting drive shaft 58 is arranged in the main housing 16 and more particularly mounted onto the suspension rotor 22 in such a way that it rotates therewith. An outward, first end 60 of the tilting drive shaft 58 is coupled to the tilting motor $M_B$ by a motion transfer mechanism 64 while the opposite, inward second end 62 of the tilting drive shaft 58 is coupled to said charge distributor 28 to selectively operate its pivoting. In this variant, the tilting input gear 54 is thus mounted to the second end 62 of tilting drive shaft 58 to be integral in rotation therewith.

Furthermore, the motion transfer mechanism 64 is configured for circumferential operation, preferably peripherally to the suspension rotor 22, for allowing transmitting motion/power from the fixed tilting motor $M_B$ to the tilting drive shaft 58 at any angular position thereof about axis A. In the variant of FIG. 1 this is advantageously achieved as follows.

The motion transfer mechanism 64 comprises a pair of large diameter toothed rings $\mathbf{66}_1$, $\mathbf{66}_2$ that are substantially peripherally arranged with respect to the stationary housing 16 and rotationally supported by means of an annular rolling bearing 68, preferably a slewing ring, extending circumferentially in the main casing 36 about axis A. The two toothed rings $\mathbf{66}_1$, $\mathbf{66}_2$ are rigidly linked to each other, so that they are rotationally integral and hence can only rotate together. In this connection, the pair of toothed rings $\mathbf{66}_1$, $\mathbf{66}_2$ may e.g. be welded together, optionally via an intermediate ring (not shown). The toothed rings assembly $\mathbf{66}_1$, $\mathbf{66}_2$ is then fixed to one race of the slewing ring 68, while the other race is fixed to one stationary wall 70 of the stationary housing 16. Partition wall 70 hence divides the main chamber 36 into two concentric, annular sub-chambers.

Toothed ring assembly 66 is located in the main casing, however behind fixed partition wall 70, forming a further protection from the harsh environment.

Reference sign 72 indicates a drive pinion fixed to the output shaft 52 of motor $M_B$ that meshes with one toothed ring $\mathbf{66}_1$ (the upper). Rotation of the output shaft 52 thus causes rotation of the pinion 72, which in turn causes the toothed ring assembly 66 to rotate about axis A.

The other (lower) toothed ring $\mathbf{66}_2$ meshes with an intermediate gear 74 mounted to an intermediate shaft 75, to which a worm 76 is also mounted. This worm 76 meshes in turn with a worm wheel 78 mounted at the first end 60 of the tilting drive shaft 58. When titling motor MR is actuated, the tilting drive shaft and worm gear set are carried along and an annular slit 71 is thus provided in the lower portion of partition wall 71 for the passage of intermediate shaft 75.

Figure 2:
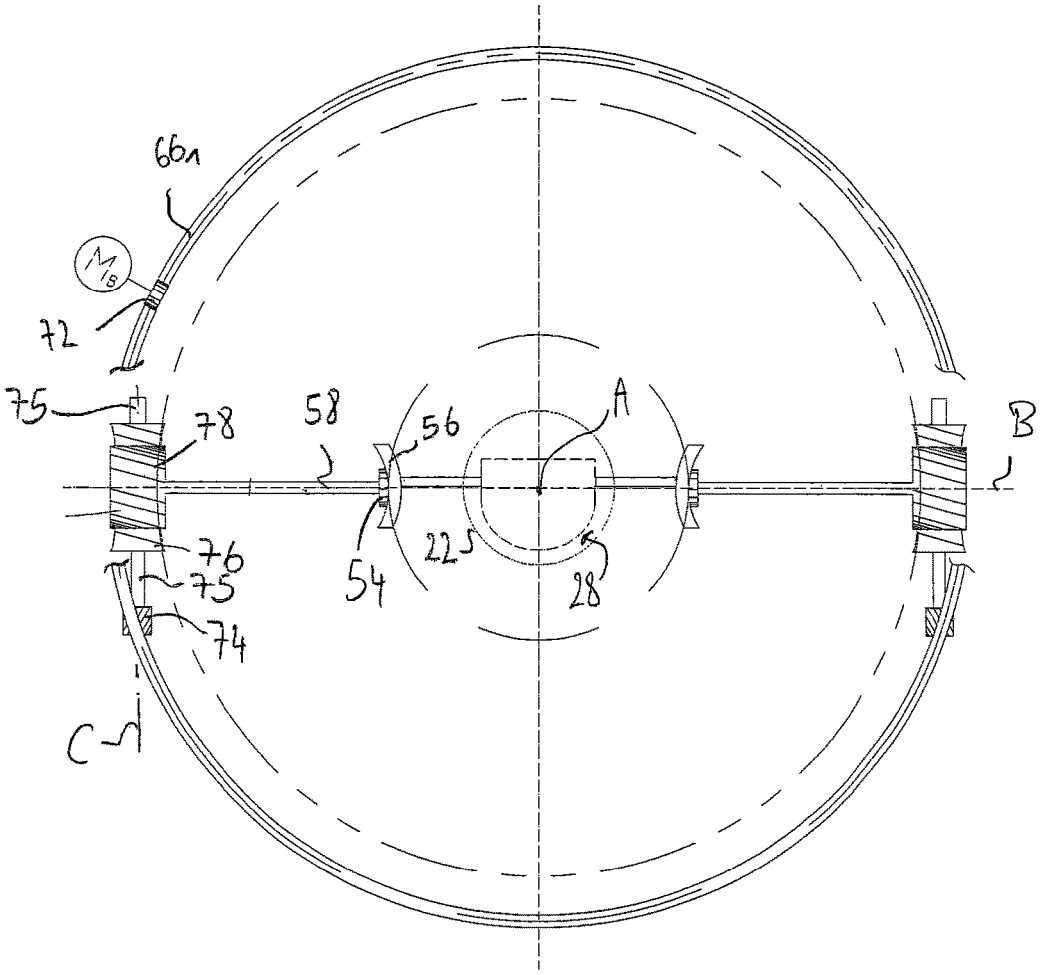
FIG. 2: is a principle diagram of the motion transfer mechanism, shown in the horizontal plane from the top of the toothed rings.

The mechanical arrangement of this worm gear set and other gears is better understood from FIG. 2. As can be seen, the worm gear set is of relatively simple design, the externally toothed (e.g. similar to a helical gear) worm wheel 78 is fixed to the tilting drive shaft 58 in a perpendicular and concentric manner.

The worm wheel 78 is driven by the worm screw 76, the rotation of which is achieved by rotation of intermediate shaft 75 about its axis C. In the present variant, the intermediated shaft 75 is perpendicular to the tilting drive shaft, and positioned with a small angle relative to the tangent of the circle described by the annular ring assembly 66. As already mentioned, the intermediate gear 74 then meshes with the second, lower toothed ring $\mathbf{66}_2$. In view of the configuration of the rotation axes, the intermediate gear 74 and the lower toothed ring $\mathbf{66}_2$ may be designed, e.g., as hypoid or spiroid gears. Alternatively, alignment problems can be solved e.g. by replacing intermediate shaft 75 by a cardan shaft (not show) rotationally connecting the intermediate gear 74 and the worm screw 76, so that each of them may be properly aligned with respect to their matching gear, i.e. lower toothed ring $\mathbf{66}_2$ and worm wheel 78.

As it can be seen, this embodiment preferably comprises a pair of tilting drive shafts 58 symmetrically arranged and similarly coupled to the transmission 64 and the arms 34 of chute 28.

The electric motors $M_R$ and $M_B$ are both fixed and situated outside the stationary housing 16, which allows for a simple, wired connection to a power supply, which is designated 73 in the Figs.

It will also be understood that as a consequence of the configuration of the tilting drive shaft 58 on the suspension rotor 22 together with the motion transfer mechanism 64, the rotation of the rotor 22 about axis A causes rotation of the tilting drive shaft 58 and hence pivoting of the chute 28. This can however be avoided by appropriate, synchronous operation of the tilting motor $M_B$. Hence, in practice, when no change of tilting angle is required, the tilting motor $M_B$ is synchronously operated when the rotor 22 is rotated by motor $M_R$, in such a way as to maintain a steady tilting angle.

Figure 3:
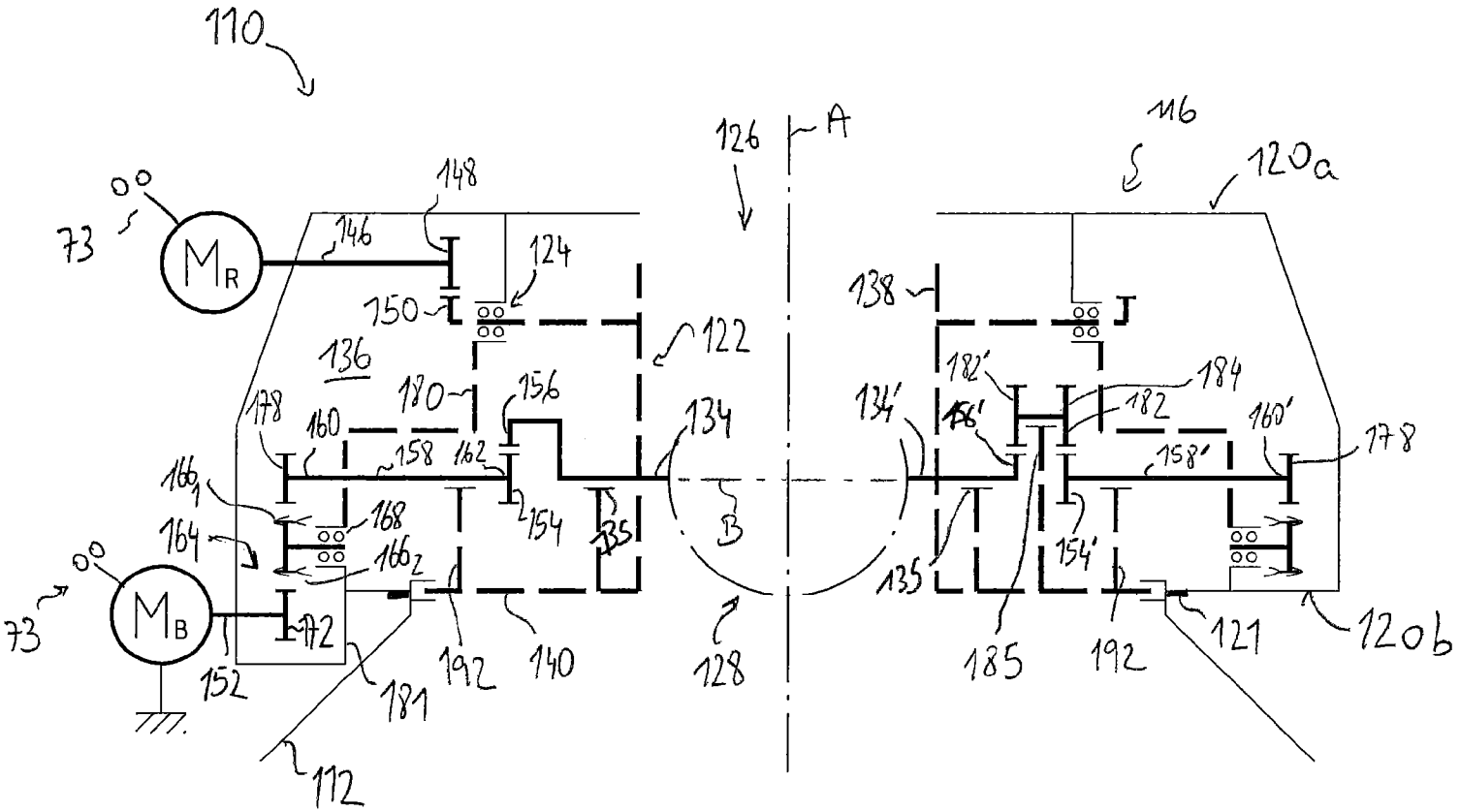
FIGS. 3 to 4: are schematic cross-sectional diagrams of further embodiments of the present rotary charging device.

Turning now to FIG. 3, another embodiment of the present rotary distribution device 110 is shown. As compared to FIG. 1, same reference signs indicate same or similar elements, unless otherwise specified, however augmented by 100.

This embodiment mainly differs from the previous one by the design of the motion transfer mechanism 164, which is carried out without worm gear set and by means of a rotating wall portion supporting the rolling bearing 168.

The configuration of the rotary drive means is similar to that in FIG. 1. The suspension rotor 122 is rotationally mounted by means of rolling bearing 124 to a fixed annular wall 139.

The main casing 136, defined by the stationary housing 116 and the suspension rotor 122 is divided into two portions by means of a second annular wall 180. Annular wall 180 is fixedly mounted in its upper region to the same race of bearing 124 as the suspension rotor 122 so that it is rotationally integral therewith (annular wall 180 is shown with dashed lines, similarly to the rotor 122, for the sake of representation).

The toothed ring assembly 166 is rotationally supported by rolling bearing 168 that is fixed to a stationary lower wall portion 181 of housing 116 and extends over the whole circumference of the sub-chamber about axis A. The two toothed rings $\mathbf{166}_1$ and $\mathbf{166}_2$ are rotationally integral and driven by tilting motor $M_B$ through its output shaft 152 and pinion 172. Tilting drive shaft 158 is coupled at its inner end 162 similarly as in FIG. 1. On its outward end 160, tilting drive shaft 158 traverses annular partition wall 180, e.g. through a hole or plain bearing, and has a gear wheel 178 directly meshing with the upper toothed ring $\mathbf{166}_1$. Tilting drive shaft 158 is carried by suspension rotor 122 so that it is fixed on the latter (in rotation about axis A) but can rotate about its longitudinal axis.

As it will be understood, when fixed tilting Motor $M_B$ is actuated, it will cause the pair of toothed rings $\mathbf{166}_1$ and $\mathbf{166}_2$ to rotate about axis A. When suspension rotor 122 is still, rotation of ring assembly 166 will hence cause rotation of tiling shaft 158 about itself, since it is maintained in a given radial position by rotor 122 and the hole/bearing in partition wall 180. This will accordingly cause rotation of the distribution chute 128 through meshing gears 154 and 156.

As in FIG. 1, the distribution chute 128 has its two arms 134 and 134' coupled to a respective titling drive shaft 158, 158', but the configuration of the motion transfer mechanism here requires a rotation inverter. The rotation inverter is located on the right hand side in FIG. 3, interposed between the main tilting shaft 158' and suspension arm 134'. It comprises one gear wheel 182 meshing without input gear 154' of the tilting shaft 158' and rotationally integral with a second gear wheel 182' that meshes with the concave toothed segment integral 156' here oriented upwards. The two gear wheels 182 and 182' are connected through a shaft 184 that is rotationally supported by a support/bearing 185 fixed to the suspension rotor 122.

Figure 4:
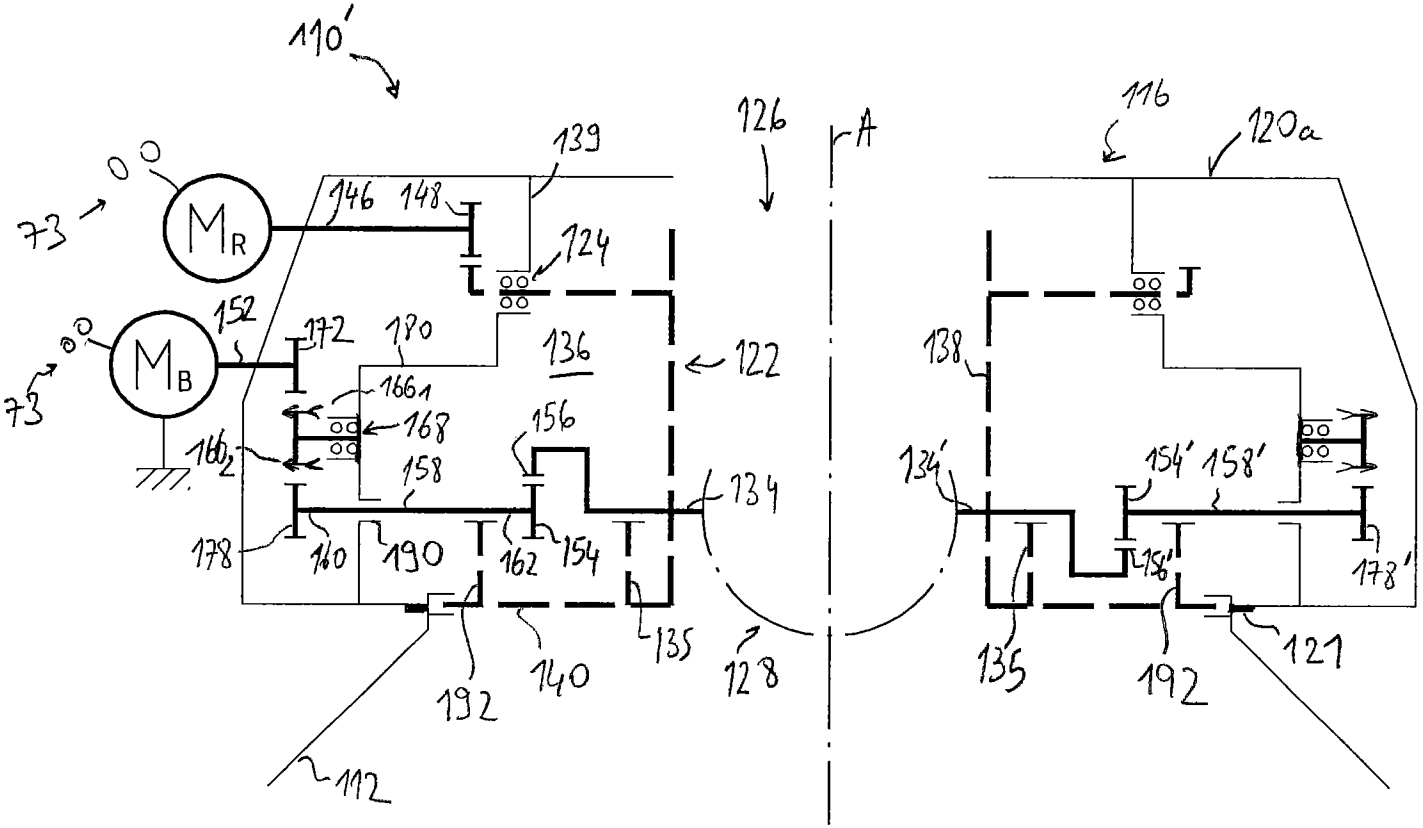

FIG. 4 shows a further embodiment 110', same or similar to FIG. 1 but with a simplified motion transfer means. Same elements are identified by same reference signs, augmented by 100 with respect to FIG. 1. A fixed, annular partition wall 180 divides the main casing into two annular concentric sub-chambers, the toothed ring assembly 166 being situated in the outer sub-chamber. The rotation of the toothed ring assembly 166 is allowed by slewing ring 168 fixedly mounted relative to the housing 16, here to partition wall 180. The tilting drive shaft 158 is supported on the rotor bottom 140 and is coupled in the previously described manner to the arm 134 of chute 28. At its opposite end, tilting drive shaft 158 passes through an annular slit 190 (in the lower part of partition wall 180) into the outer sub-chamber, where it has its gear wheel 178 meshing with the lower toothed ring $\mathbf{166}_2$.

The second drive shaft 158' (right hand side of FIG. 4) is coupled in a same manner to the lower toothed ring $\mathbf{166}_2$. The rotation is inverted by arranging the output ring segment 156' below the input gear 154'.

It may be noticed that the positions of the tilting motor $M_B$ and the tilting shaft 158 may be inverted, i.e. the tilting motor $M_B$ may be located below the toothed ring assembly 166 so that pinion 172 meshes with the lower toothed ring $\mathbf{166}_2$ and tilting shaft 158 has its gear wheel 178 meshing with the upper toothed ring $\mathbf{166}_1$. This configuration would be similar to that shown in FIG. 3, with the exception that partition wall 180 is fixed, thus requiring an annular slit (similar to slit 190 in FIG. 4) in fixed partition wall 180, above the toothed ring assembly 166, for the passage of the tilting shaft 158.

Reference signs 92, 192 indicate bearings supporting the tilting drive shaft 58, 158 (for rotation about its longitudinal axis) on the bottom flange 40, 140 of suspension rotor 22, 122. For the sake of illustration, only one such bearing 92, 192 is shown per rotating shaft, although at least two such bearings 92, 192 per shaft is considered more appropriate. Similarly, any appropriate means may be employed for rotationally supporting the tilting drive shafts 58, 158.

Although not illustrated in the drawings, the present rotary charging devices may advantageously be equipped with any appropriate means to prevent the entrance of dust into the main casing 36, e.g. by means of a nitrogen overpressure. In addition, seals, e.g. water seals, may be arranged so as to close the operating gaps between the rotor 22 and the corresponding portions of the stationary housing 16.

Also, the rotary charging devices may feature an additional cooling system, e.g. comprising a rotary circuit portion fixed on the suspension rotor 22 and a stationary circuit portion fixed to the stationary housing 16. Such cooling system is e.g. described in WO 2011/023772.

In all of the above embodiments, the engines $M_R$ and $M_B$ may be operated by a controller (not shown). Rotation of motor $M_R$ causes rotation of the tilting drive shaft 58, 158 and hence pivoting of the chute. If this is not desired, the controller operates the tilting motor $M_B$ in synchronism with $M_R$ to avoid such pivoting and keep a substantially steady tilting angle.

The invention claimed is:

1. A rotary charging device for a shaft furnace comprising:
a stationary housing for mounting on the throat of the shaft furnace;
a suspension rotor supported in said stationary housing so that it can rotate about a substantially vertical axis, said suspension rotor and stationary housing cooperating to delimit an annular chamber forming the main casing of said rotary charging device;
a charge distributor pivotally suspended to said suspension rotor;
rotary drive means for rotating the suspension rotor about its axis;
tilting drive means for pivoting said charge distributor about a substantially horizontal pivoting axis, independently from said rotary drive means, wherein said tilting drive means comprises:
a tilting motor fixedly mounted relative to said stationary housing and laterally positioned relative to said suspension rotor, wherein the tilting motor output shaft is horizontal;
a tilting drive shaft in said main housing that is mounted onto said suspension rotor, an outward, first end of said tilting drive shaft being coupled to said tilting motor by motion transfer means while the opposite, inward second end of said tilting drive shaft is coupled to said charge distributor to selectively operate its pivoting, said motion transfer means being configured for operating peripherally to said suspension rotor in such a way as to allow transmitting power from said tilting motor to said tilting drive shaft at any angular position of said suspension rotor;
wherein said motion transfer means comprise a pair of rotationally integral large diameter toothed rings mounted in said main casing so as to be rotatable about said vertical axis, a first of said toothed rings being drivingly connected to said tilting motor, while the second toothed ring is operatively coupled to said tilting drive shaft first end in such a way that the rotation of said toothed rings results in a corresponding rotation of said tilting drive shaft about its axis.

2. The rotary charging device according to claim 1, wherein said coupling between said tilting drive shaft and said charge distributor is carried out by an input tilting gear mounted to said tilting drive shaft second end that meshes with an output tilting gear rotationally integral with a suspension arm of said charge distributor.

3. The rotary charging device according to claim 1, wherein said pair of toothed rings is rotationally supported by an annular rolling bearing.

4. The rotary charging device according to claim 1, wherein said large diameter toothed rings surround said suspension rotor.

5. The rotary charging device according to claim 1, wherein said motion transfer means comprise a worm gear set coupling said second toothed ring to said tilting drive shaft.

6. The rotary charging device according to claim 1, wherein said large diameter toothed rings are arranged in a sub-chamber of said main casing, separate from said suspension rotor and tilting drive shaft.

7. The rotary charging device according to claim 1, wherein said motion transfer means operate the coupling of said second toothed ring to said tilting drive shaft through an annular slit connecting a sub-chamber containing said toothed rings from a sub-chamber having its inner end delimited by said suspension rotor.

8. The rotary charging device according to claim 1, comprising a pair of opposite tilting drive shafts mounted on said suspension rotor, each driven by said toothed rings and coupled to a respective suspension arm of said charge distributor.

9. The rotary charging device according to claim 1, wherein an annular partition wall is rotationally mounted in said main casing and rotationally integral with said suspension rotor; and
said tilting drive shaft traverses said partition wall and has at its first end a gear wheel meshing with one of said toothed rings, while the other toothed ring is connected to said tilting motor to be driven thereby.

10. The rotary charging device according to claim 9, wherein a further tilting drive shaft mounted on said suspensions rotor opposite the first drive shaft, similarly driven by said toothed rings however connected to the respective suspension arm of said charge distributor by a rotation inverter.

11. The rotary charging device according to claim 1, wherein said tilting drive shaft has a gear wheel mounted at its first end that meshes with one of said toothed rings.

12. The rotary charging device according to claim 1, wherein a rotary motor for driving said rotary drive means.

13. The rotary charging device according to claim 1, wherein said tilting motor and said rotary motor are fixedly mounted to said stationary housing and below an upper flange structure.

14. The rotary charging device according to claim 1, wherein said suspension rotor comprises a cylindrical body and a bottom flange.

15. The rotary charging device according to claim 1, wherein said tilting motor and/or said rotary motor is/are installed inside a casing.

16. The rotary charging device according to claim 1, wherein said stationary housing has upper and lower mounting flanges as well as an external casing extending therebetween.

17. A shaft furnace, in particular a blast furnace, comprising a rotary charging device according to claim 1.

18. The rotary charging device according to claim 1, wherein said tilting motor is fixedly mounted to said stationary housing and below an upper flange structure.

* * * * *